US006123472A

United States Patent [19]

Elgee

[11] Patent Number: 6,123,472

[45] Date of Patent: Sep. 26, 2000

[54] INDEXING STOP FOR A PRINTER CARRIAGE

[75] Inventor: Steven B. Elgee, Portland, Oreg.

[73] Assignee: Hewlett-Packard Company, Palo Alto, Calif.

[21] Appl. No.: 09/282,051

[22] Filed: Mar. 29, 1999

[51] Int. Cl.[7] ..... B41J 21/00

[52] U.S. Cl. ..... 400/283; 400/284

[58] Field of Search ..... 400/294.3, 295, 400/295.1, 295.2, 296, 306, 315, 320, 320.1, 321, 333, 283, 284, 289, 294

[56] References Cited

U.S. PATENT DOCUMENTS

| | | | |
|---|---|---|---|
| 1,730,040 | 10/1929 | Kurowski | 400/289 |
| 4,440,512 | 4/1984 | Forcier | 400/144.2 |
| 4,920,355 | 4/1990 | Katerberg | 346/1.1 |
| 4,921,365 | 5/1990 | Sanders, Jr. et al. | 400/322 |
| 4,952,084 | 8/1990 | Maruyama | 400/120 |
| 5,184,336 | 2/1993 | Wanger et al. | 369/34 |
| 5,433,543 | 7/1995 | Sturman | 400/314 |
| 5,462,371 | 10/1995 | Beretta et al. | 400/569 |
| 5,602,573 | 2/1997 | Waschhauser et al. | 347/33 |
| 5,771,054 | 6/1998 | Dudek et al. | 347/102 |
| 5,779,376 | 7/1998 | Seu | 400/335 |

*Primary Examiner*—John S. Hilten
*Assistant Examiner*—Daniel J. Colilla

[57] ABSTRACT

An indexing stop is moveable relative to a printer carriage that carries cartridges for printing a swath at a time. Part of the stop is in the path that the carriage travels. The stop is advanced while the cartridges print one, "first" swath (that is, while the carriage is stationary). The stop is advanced to a position corresponding to the location where the carriage is to be moved to facilitate printing of the next, "second" swath. Once the first swath is printed, the carriage is controlled to move toward and abut the stop, thus arriving in the location for printing the second swath. The stop simplifies and speeds the carriage movement between swaths, thereby increasing printer throughput.

17 Claims, 4 Drawing Sheets

INDEXING STOP FOR A PRINTER CARRIAGE

TECHNICAL FIELD

This invention relates to the control of a carriage that moves print cartridges in a printer.

BACKGROUND AND SUMMARY OF THE INVENTION

An inkjet printer includes one or more ink-filled print cartridges that are mounted to a carriage in the printer body. Normally, the carriage is scanned across the width of the printer as paper or other print media is advanced through the printer. Each ink-filled cartridge includes a printhead that is driven to expel droplets of ink through an array of nozzles in the printhead toward the paper in the printer. The timing and nominal trajectory of the droplets are controlled to generate the desired text or image output and its associated quality.

Hereafter, the term "paper" will be used to collectively refer to any type of print media (cut-sheet paper of any weight, including photo-grade paper, transparencies, envelopes, etc.) that may be used as media in modern inkjet printers.

The scanning-type printers expel ink while the carriage is reciprocated across the width of the paper. Thus, a swath of ink is printed with each scan, and the paper is advanced to a new location between printing swaths.

Throughput, which is normally measured in printed pages per minute, is an important design consideration in connection with printers of all types. The goal is to maximize throughput without deleterious effects on print quality.

One way to increase throughput in inkjet printers is to combine inkjet cartridges in a printer so that the swath width is enlarged but while maintaining the printheads and paper parallelism. To this end, the paper may be carried on a rotating drum or similar carrier member and advanced through the printer. Sets of cartridges, each set having the same color of ink, are carried near the drum. The cartridges are arranged in a carriage such that the swath of one cartridge combines with the swath of the other cartridge of the set. As a result, the width of the printed swath for a given color is the sum of the individual cartridge swath widths.

A carriage may be provided for carrying the cartridges in the just mentioned arrangement for combining the swath widths of the individual cartridges. The components of the carriage may be configured such that two cartridges of the same color ink are precisely positioned relative to each other, and so that multiple sets of relatively small cartridges are carried near the drum so that a full range of colors can be printed.

In a rotating-carrier type of printer just mentioned the printable surface of the paper (which can be considered as the entire surface of the paper between the leading and trailing edges of the paper) is repeatedly directed to be adjacent to the printheads of the cartridges that are carried by the carriage. A swath of ink is printed while the printable surface is adjacent to the printheads. After the trailing edge of the paper passes from adjacent to the printheads, and before the leading edge of the paper is again directed to be adjacent to the carriage, the carriage is shifted by an incremental amount corresponding to one swath width.

Put another way, the space on the paper carrier that is between the trailing and leading edges of the paper can be considered as a gap. This gap has a length dimension.

Moreover, the gap has a time dimension that relates to the size and rotation speed of the carrier, as well as the size of the paper. Accordingly, the gap on a rotating carrier is adjacent to the carriage for a specific time period (hereafter referred to as the "gap period") depending on these factors.

To maximize throughput, the printer should be operated at a high rotation speed so that the required swaths can be printed as quickly as possible. This means that the size of the gap should be minimized. The gap size must be large enough, however, to enable the carriage to shift into position while the gap is adjacent to the carriage, so that the carriage is in position to print the next swath before the leading edge of the paper is again directed to be adjacent to the printheads of the carriage.

The overall mass of a carriage, especially a carriage that carries a plurality of print cartridges, is an important consideration in determining how quickly and precisely the carriage can be moved between printing swaths. The time required for precise carriage movement may be a limiting factor in sizing the gap and gap period. In short, the gap period must be long enough to allow the complete and precise incremental movement of the carriage.

The present invention is directed to a method and apparatus for minimizing the time required to accomplish the incremental carriage movement, hence minimizing the gap size to increase printer throughput.

In a preferred embodiment there is provided a movable indexing stop that is advanced relative to the carriage and in the path that the carriage travels. The stop is advanced while the printheads are printing one, "first" swath (that is, while the carriage is stationary). The stop is advanced to a position corresponding to the location where the carriage is to be moved to facilitate printing of the next, "second" swath. Once the first swath is printed, the carriage is controlled to move toward and abut the stop, thus arriving in the location for printing the second swath.

The use of the stop simplifies the carriage movement in at least two respects. Firstly, the stop position is changed during the time period that the carriage is stationary for printing. This time period (hereafter referred to as the print period) corresponds to the amount of time that the paper is adjacent to the carriage. In a preferred embodiment, the print period is considerably longer than the gap period. As a result, there is a relatively long time period (as compared to the gap period) for precisely advancing stop to the position for stopping movement of the carriage to print the next swath. Secondly, the controlled, incremental movement of the carriage is simplified to quickly moving the carriage against the pre-positioned stop. This obviates the need for more precise movement control that would be required in the absence of a stop, especially for a carriage having a large overall mass.

As a result of the use of the stop, and the attendant, quick incremental movement of the carriage, the gap and/or gap period can be minimized and thereby increase printer throughput.

Other advantages and features of the present invention will become clear upon study of the following portion of this specification and the drawings.

DETAILED DESCRIPTION OF PREFERRED EMBODIMENTS

Figure 1:
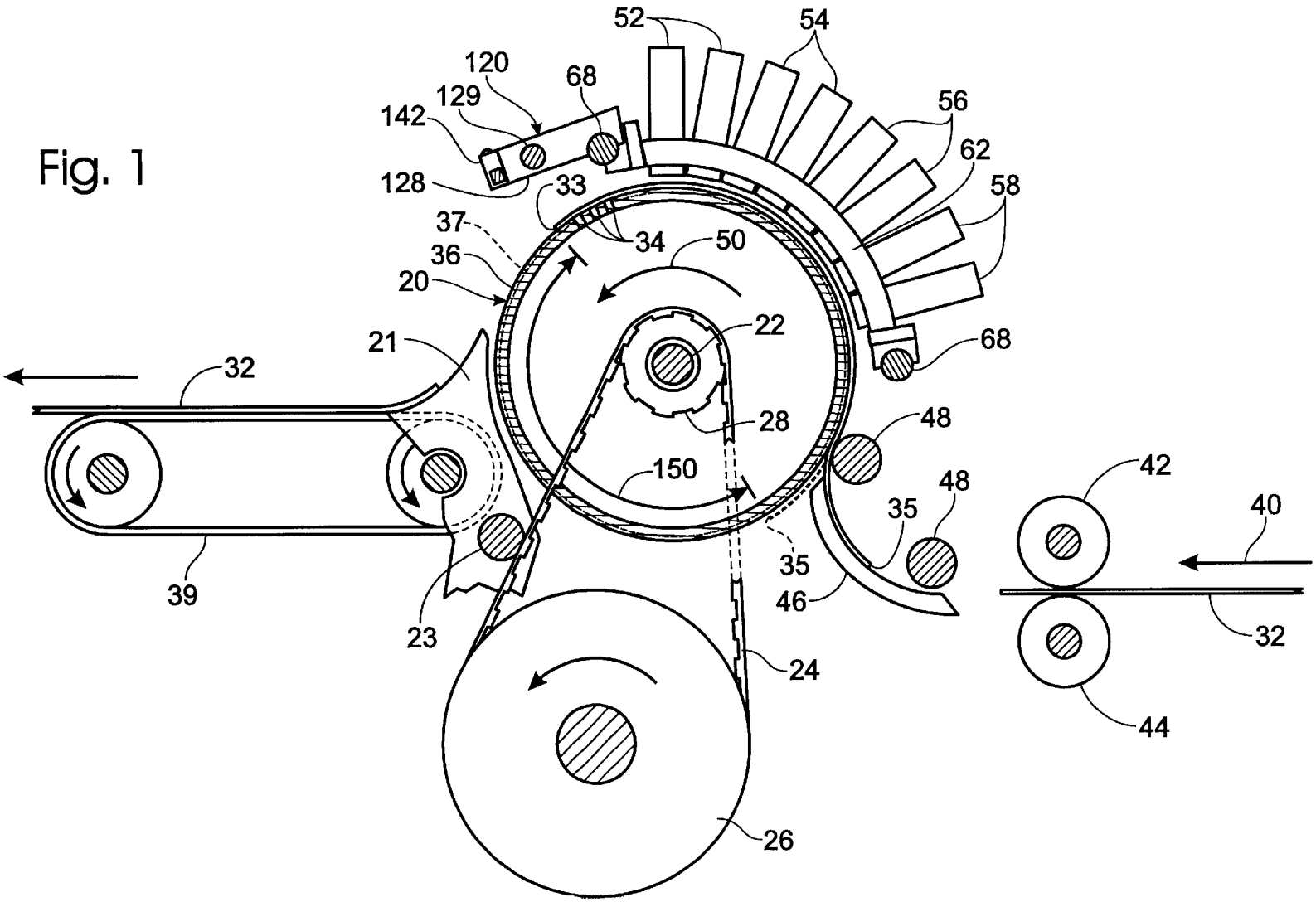
FIG. 1 is a diagram showing in side view an arrangement of printer components for implementing a preferred embodiment of the carriage and indexing stop assembly of the present invention.
Figure 2:
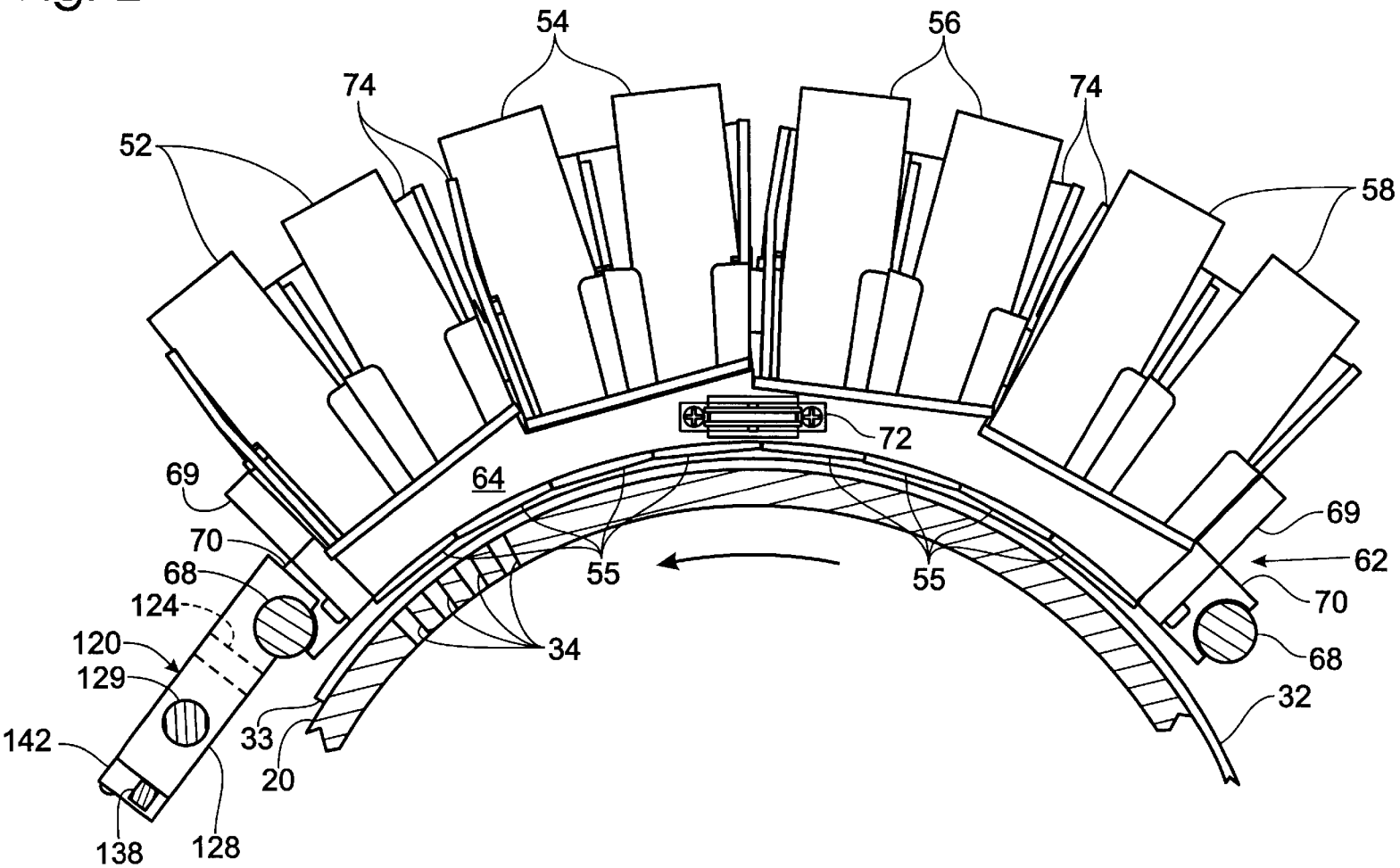
FIG. 2 is an enlarged detail side view of the assembly shown in FIG. 1.

With reference to FIGS. 1 and 2, a preferred embodiment of the present invention includes a drum 20 that is supported by a shaft 22 within a printer. The drum 20 preferably has a circumference of about 50 cm, although any of a variety of drum sizes will suffice.

An endless drive belt 24 engages a gear 28 that is fixed to one end of the drum shaft 22. That belt also engages a drive pulley 26 (FIG. 1). In a preferred embodiment, a motor (not shown) continuously drives the pulley 26 to rotate the drum whenever a printing operation is carried out.

A regulated vacuum source (not shown) is applied via tubing to the interior of the drum as a mechanism for securing a sheet of paper 32 to the drum 20 as the paper is advanced through the printer over the drum. To this end, the drum is perforated with vacuum ports 34 that extend between the interior of the drum and the outer surface 36 of the drum. The suction present in the ports 34 secures to the drum outer surface 36 the paper 32 that is guided into contact with the drum, as is described next.

Before proceeding, however, it is noted that the vacuum method of securing-paper to drum is only one of a number of suitable approaches. For example, electrostatic attraction, clamping mechanisms, temporary adhesives, etc. can be used to secure the paper.

The portion of the path of the paper 32 through the printer is illustrated in somewhat simplified fashion in FIGS. 1 and 2. The paper 32 is picked from an input tray and driven into the paper path in the direction of arrow 40. The leading edge 33 of the paper is fed into the nip between a drive roller 42 and an idler or pinch roller 44. From there the paper 32 is driven in a controlled manner into contact with a curved guide 46 that, in cooperation with guide rods 48, directs the leading edge of the paper 32 into tangential contact with the exterior surface 36 of the drum 20. The guide rods are removed from contact with the paper as soon as the drum holds the paper.

As the vacuum ports 34 of the drum rotate into contact with the paper 32 the suction established between the paper and drum secures the paper to the drum as the drum continues to rotate in the direction of arrow 50.

Once the printing operation respecting a particular sheet of paper is complete (which can require several revolutions of the drum and paper, as discussed below) the paper is removed from the drum. This can be carried out by the controlled, temporary movement of guide prongs 21 (FIG. 1) that pivot about a post 23 into a circumferential grooves 37 formed in the drum. This redirects the paper from the drum to a conveyor belt 39 that delivers the paper to a collection tray.

As the paper 32 is moved by the drum, it passes very closely to, but does not contact, the undersides of sets of inkjet cartridges that are carried near the drum 20. Four sets of cartridges 52, 54, 56, 58 are shown in FIGS. 1 and 2. In the present description, the term "cartridge" is intended to mean any conventional device for storing and printing droplets of ink therefrom. Sometimes these devices are referred to as cartridges or printheads. In a preferred embodiment, cartridges such as those available from Hewlett Packard Co. for use with the 2000 Series Color Printer (part numbers: C4800A, C4801A, C4802A, and/or C4803A) are preferred. The cartridges may be connected to remote sources of ink that supplement the ink supply that is stored in each cartridge.

As explained more fully below, each cartridge set is supported above the paper 32 by a carriage 62. A printhead 55 is attached to the underside of each cartridge. The printhead is a planar member and has an array of nozzles through which the ink droplets are ejected. The cartridges are supported so that the printheads of the cartridges are maintained at a desired spacing from the paper (such as, for example, from about 0.5 mm to slightly more than 1.5 mm) and so that the arrays of nozzles on the printheads are maintained in substantially parallel relationship with the paper 32 in the direction of the axis of rotation of the drum.

The carriage 62, secures the cartridges so that one cartridge in a set is offset relative to the other cartridge. Specifically, these two cartridges 52 combine to print a swath of ink that has a predetermined width shown as S1 in FIG. 4.

The second two-cartridge set 54 is a different color than its mate set 52 and is held in the carriage and arranged so that the swath of this set 54 is precisely aligned to overlay swath S1. The same is true for the other two cartridge sets 56, 58.

Figure 4:
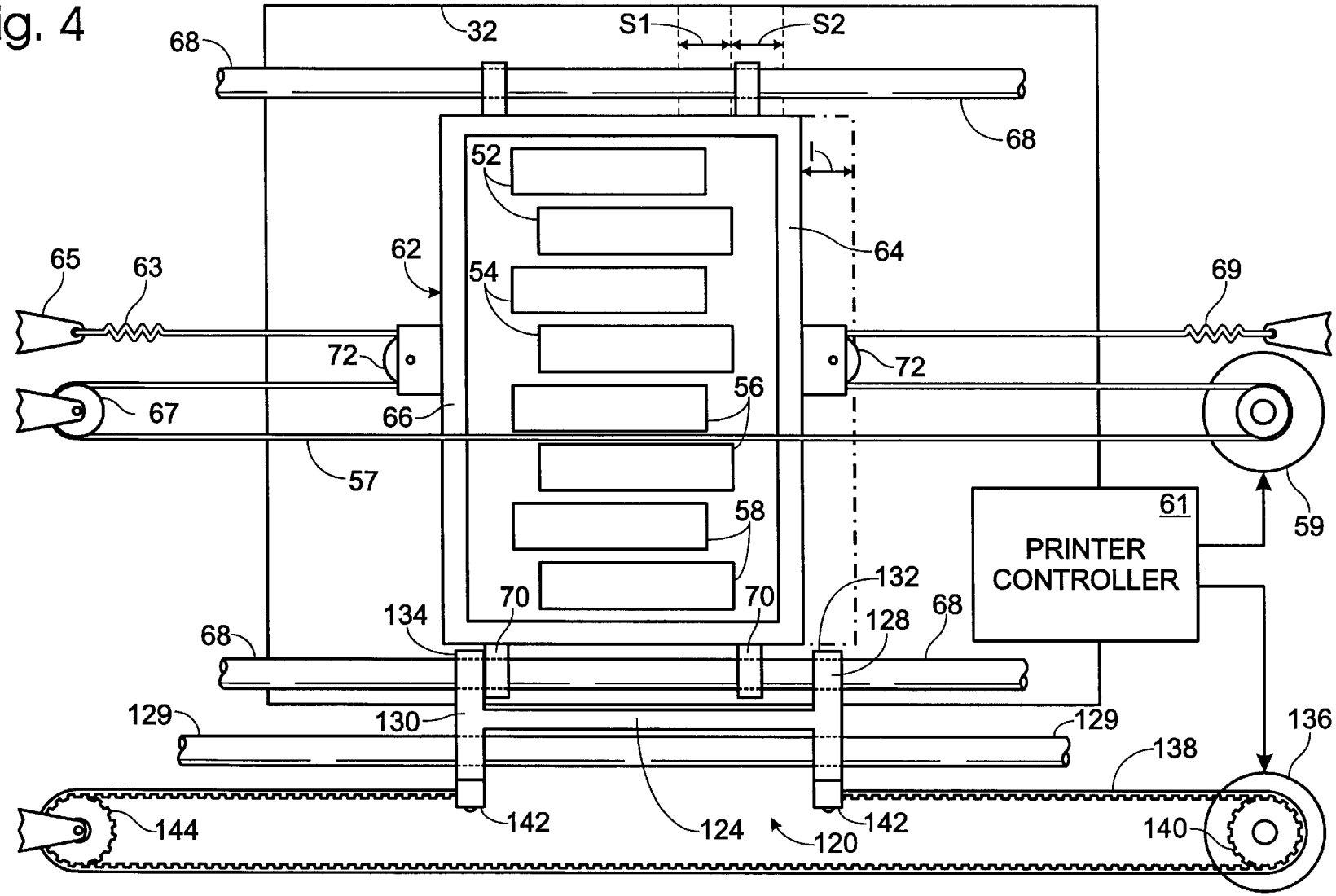
FIG. 4 is a top view diagram illustrating, among other things, control mechanisms of the present invention.

More particularly, the group of four sets of two cartridges each are carried near the drum by four carriage components 74 of a carriage 62 (see FIGS. 2 and 4). One cartridge set 52 carries two black ink cartridges, another set 54 carries two magenta ink cartridges, another set 56 carries two cyan ink cartridges, and the other set 58 carries two yellow ink cartridges. The swaths of each set of two cartridges align in the direction that the print medium is advanced, thereby to print over the same swath width S1 for providing full-color output.

The swath S1 is printed as the paper 32 is directed past the carriage by the rotating drum 20, and while the cartridge sets are held in the carriage without movement relative to the printer.

After swath S1 is printed, the carriage 62 is moved by an incremental distance "I" (FIG. 4) in a direction that is parallel to the axis of the drum shaft 22. In this location, the print cartridge sets are properly placed to print a second swath S2 that is next to the prior-printed swath S1. Swaths S1 and S2 overlap to a degree necessary to account for carriage and printhead manufacturing tolerances so that the combined swath S1+S2 is essentially the sum of those swath widths. After swath S2 is printed, additional swaths are printed as the carriage 62 incrementally moves the cartridge sets across the entire width of the paper 32 (left-to-right or right-to-left in FIG. 4).

In accordance with the present invention, the incremental movement of the carriage 62 is controlled by an indexing stop 120, the particulars of which, as well as those of the carriage, are described next.

Figure 3:
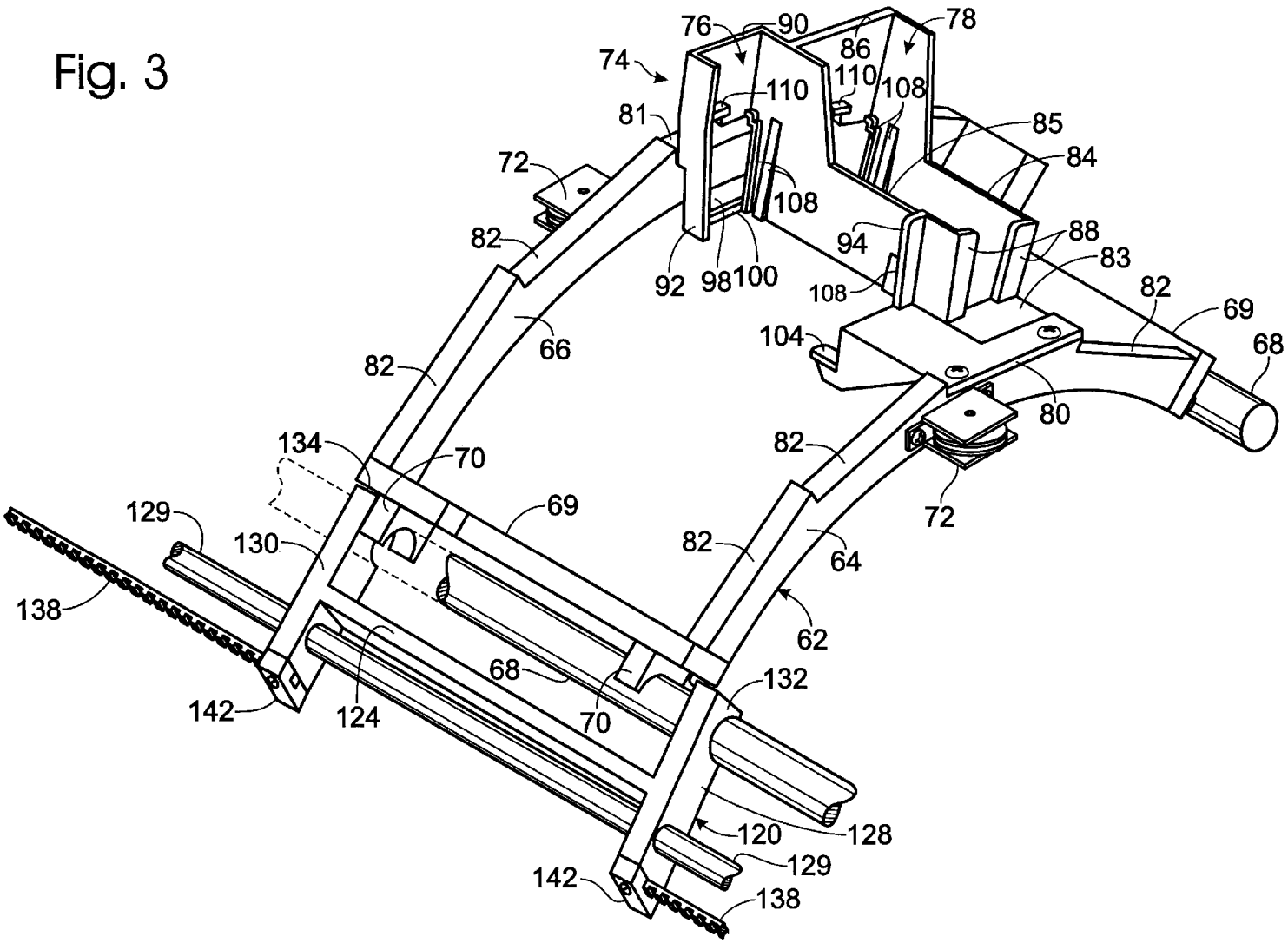
FIG. 3 is a perspective view of the primary carriage and indexing stop components of the present invention.

The carriage 62 is, for clarity, shown in a somewhat stripped-down state in FIG. 3 and includes two, spaced-apart, rigid frame members, which for convenience will be designated as a front frame member 64 and a back frame member 66. The frame members are generally arcuate in shape and span between two guide rods 68 that are fixed to extend across the width of the printer. The opposing ends of each frame member 64, 66 are joined by bridge pieces 69. The bridge pieces have attached thereto generally C-shaped brackets 70 that slidably engage the guide rods 68.

The carriage 62 (including the frame members and carriage components described below) moves as a unit back and forth across the width of the paper. As noted, the carriage movement occurs after one swath S1 is printed from the leading edge 33 to the trailing edge 35 of the paper 32.

The frame members 64, 66 support four carriage components 74. Only a single carriage component 74 is shown in FIG. 3. FIG. 2 shows a carriage components 74 in side view. Preferably, the four carriage components 74 are identical, injection-molded parts, thus the following discussion of one of the carriage components 74 applies to all.

In general, a carriage component 74 includes thin walls that define two adjoining bays 76, 78. The bays are openings into which fit the cartridges, such as those of the above-described cartridge sets 52, 54, 56, 58. One end of the carriage component 74 includes a flat projecting flange 80 that is fastened to a flat 82 on the front frame member 64. In the preferred embodiment, the upper side of the front and back frame members 64, 66 are each formed with four such flats 82. One flat is angled at about 22.5 degrees relative to the next flat so that the four carriage components 74 mount to those flats in a manner that generally conforms to the curvature of the preferred underlying drum 20.

The flange 80 is integrally formed with and projects from a central wall 85 of the carriage component 74. That wall 85 is roughly perpendicular to the flange and separates the two bays 76, 78. Bay 78 is defined by the central wall 85, an opposing side wall 84, a back wall 86, and a pair of front corner partitions 88 arranged as shown best in FIG. 3. The other bay 76 is defined by the central wall 85, a back wall 90, a side partition 92, and a front corner partition 94.

As respects one bay 78, the side wall 84 converges in the downward direction relative to the central wall so that the size of the bay tapers in the downward direction.

As respects the other bay 76, the side partition 92 converges in the downward direction relative to the central wall 85 so that the size of the bay 76 also tapers in the downward direction.

As a result of the angular relationships between the central wall 85 and the respective side wall 84 and side partition 92, cartridges inserted into the bays will have centerlines that are angled relative to one another. These centerlines are common with a radial projection from the center of the drum. As a result, the nozzle array in each planar printhead 55 (which printhead is mounted to the underside of the cartridge) is substantially parallel to the portion of the paper to which the printhead is closest.

In this embodiment, the back walls 86, 90 of the bays include clearance openings 98 through which are exposed parts of the inserted cartridges that carry conductive contacts. These contacts are the exposed termini of circuitry internal to the cartridge for driving the printheads to print ink. These cartridge contacts are thus accessible in the bay for contact with mating contacts carried on the back frame member 66, which communicate, as by a ribbon-type multi-conductor, with the printer controller.

As shown in FIG. 3, a tab 81 projects from the back walls 90, 86 of each bay to be secured to the flat 82 on the back frame member 66 in a manner similar to how flange 80 is secured to the front frame member 64.

The precise, repeatable positioning of a cartridge within a bay is accomplished with the use of features 100, 102, 104, 108, 110 that are integrally formed with the carriage component 74 and mate with or otherwise engage corresponding parts on the cartridge body.

It will be appreciated that fewer or more sets of cartridges may be mounted to a carriage. For example, the carriage could be configured to carry a second group of four sets of two same-color cartridges.

Sets of cartridges need not be limited to pairs of same-color cartridges. Sets employing three or more same-color cartridges, or employing more than four differing ink colors are also contemplated.

In the preferred embodiment, the sets of same-color cartridges are secured in the carriage component 74 so that the associated same-color swaths are precisely aligned with no gap or overlap, which would result in noticeable degradation of print quality. This precise relative positioning is dependent upon the precise relative positioning of the molded features (100, 102, 104, 108 etc) in the adjoining bays 76, 78.

The mechanism for reciprocating the carriage 62 across the paper includes a pair of pulleys 72, one pulley mounted on each frame member 64, 66. The pulleys engage a belt 57 that also engages the drive pulley of a drive motor 59 (FIG. 4). The motor 59 is responsive to the printer controller 61 for moving the carriage 62 in increments as described above.

The carriage drive belt 57 is preferably arranged so that one end 63 is attached via a spring to one side 65 of the printer chassis. The belt passes through the pulley 72 on the back frame member 66 and then through a stationary idler pulley 67 from where it extends to engage the drive motor 59. The other end of the carriage drive belt 57 is connected via a spring 69 to the printer chassis and passes through the pulley 72 on the front frame member 64 before reaching the drive motor 59.

One preferred embodiment of the indexing stop 120 of the present invention includes a rigid, elongated, bar-shaped base 124. The front of the base 124 attaches to a front abutment 128. The front abutment is a bar-shaped member that includes an aperture through which passes a guide shaft 129. The guide shaft 129 extends parallel to the guide rod 68 over which the carriage 62 slides and is fixed to extend across the width of the printer.

The guide shaft 129 also passes through an aperture in a bar-shaped back abutment 130 to which is attached the other end (that is, the end opposite the front abutment 128) of the stop base 124. Both the front abutment 128 and back abutment 130 of the stop extend from the shaft 129 by an amount sufficient to sildably engage the guide rod 68. In this regard, the outermost end 132 of the front abutment 128 includes an opening through which the guide rod 68 passes. An identical opening is provided through the outermost end 134 of the back abutment 130.

With reference to FIGS. 3 and 4, the motion of the stop 120 is controlled by a stepper-type motor 136 that is actuated by the printer controller 61. The teeth of a drive belt 138 engage the motor drive pulley 140. One end of that drive belt 138 is connected, as by a clamp 142 to the front abutment 128. Similarly, a clamp 142 attaches the other end of the belt 138 to the back abutment 130. On the side of the printer opposite the motor 136, the belt passes through a fixed idler pulley 144.

With particular reference to FIGS. 1 and 4, the operation of the indexing stop 120 to control the incremental movement of the carriage 62 is next described.

The paper 32 is directed to the drum 20 and rotated so that the printable surface between its leading end 33 and trailing end 35 is repeatedly directed adjacent to the carriage 62 so that the cartridge sets carried on the carriage can be controlled to print onto the paper.

It is noteworthy here that, as respects the printing operation, the term "adjacent" means that the paper is located relative to the carriage such that ink expelled from at least one printhead 55 would contact the printable surface of the paper. As respects the gap 150 (FIG. 1) representing the portion on the drum 20 of the where no part of the paper 32 is carried, the gap is "adjacent" to the carriage when ink expelled from at least one printhead 55 would not contact any part of the printable surface of the paper.

After one swath is printed and the trailing edge 35 of the paper leaves the region adjacent to the carriage, the gap 150 is rotated (via the counterclockwise drum rotation) into the position adjacent to the carriage 62.

FIG. 1 is not to scale. In a preferred embodiment of the present invention, the drum size and rotation speed are selected so that the printable surface of the standard sized paper 32 resides, at least in part, adjacent to the carriage for about 0.6 seconds. The gap 105 is adjacent to the carriage for about 0.1 seconds. More generally, the gap period during which the carriage is to be incrementally moved is substantially shorter than the print period.

While the carriage is stationary and the cartridges it carries are printing a swath such as S1 in FIG. 4, (that is, during the relatively long print period) the stop 120 is advanced along the guide shaft 129. To this end, the printer controller actuates the drive motor 136 to rotate the drive pulley (clockwise, for example) by an amount sufficient to advance the stop a distance corresponding to one swath width, such as shown as "I" in FIG. 4. In this position, the end 132 of the front abutment 128 lies in the path of the carriage 62, and particularly in the path of the carriage brackets 70 that slide on the guide rod 68.

The stop is held in the just-described position until the printing of the swath S1 is completed and the gap (not the paper) is adjacent to the carriage. The carriage drive motor 59 is then activated to move the carriage toward and into abutting contact with the stop 120. In particular, the bracket 70 abuts the end 132 of the stop abutment 128.

In a preferred embodiment, the motor 59 is simply controlled to move the carriage quickly by an amount (an "overdrive" distance) that is slightly greater than the distance "I" so that the carriage rapidly moves into the proper location for printing swath S2. The spring 69 yields slightly to permit this overdrive distance to be applied to the belt 57 without damage to the belt.

During the time swath S2 is printed, the stop 120 is advanced in a manner as just described to a position that corresponds to a swath width and to the location where the carriage can thereafter be move to print the next swath.

In a preferred embodiment, the cartridges and carriage 62 are controlled to scan and print back and forth across the width of the paper, and the stop 120 is configured to provide its motion limiting characteristics irrespective of the carriage motion direction. Thus, the distance between the two stop abutments 128, 130 is selected (i.e., one carriage width+one swath width) so that as the carriage is printing the last swath on one side of the paper (such as the right side in FIG. 4), the end 134 of the rear abutment 130 is located in the path that the carriage travels in scanning in the right-to-left direction, and at the position corresponding to the next-to-be-printed swath as the carriage moves incrementally toward the left side of the paper. As that swath is printed, the stop 120 is advanced to the left in a manner as described above with respect to the right-to-left movement.

Although preferred embodiments of the invention have been described, it will be appreciated by one of ordinary skill that the spirit and scope of the invention is not limited to those embodiments. For example, the stop 120 can take on any of a variety of configurations, and need not be provided with a separate guide shaft (it can be carried on the rods 68 alone).

The stop may also be configured to move in increments transverse to the direction of carriage motion. Such a stop would be configured with, for example, a stepped or saw-tooth portion comprising a number of different contact surfaces facing the carriage. Thus, each incremental movement of the stop (which movement occurs while the carriage is halted for printing) would present a new contact surface, spaced from the previous contact surface, against which the carriage can be moved to print the next swath.

Similarly, one of ordinary skill will appreciate that there are a wide variety of approaches for independently controlling the motion of the stop and carriage. The carriage configuration need not match that of the preferred embodiment. In short, the invention described herein extends to the various modifications and equivalents as defined in the appended claims.

What is claimed is:

1. A method of controlling movement of a carriage along a path in a printer, comprising the steps of:

providing the carriage with a print cartridge that is controllable for printing ink onto print media that is adjacent to the carriage;

advancing a stop to a first position in the path of the carriage while the carriage is held stationary;

moving the carriage to abut the stop while holding the stop at the first position;

advancing the stop to a second position;

moving the carriage to abut the stop when the stop is in the second position; and printing from the print cartridge while the stop is advancing.

2. The method of claim 1 including the step of halting printing of the ink onto the print media while the carriage is moving.

3. The method of claim 1 including the steps of:

directing the print media through the printer in a first direction relative to the carriage; and moving the carriage to abut the stop in a direction that is substantially perpendicular to the first direction.

4. A method for printing ink from a print cartridge that is carried by a carriage so that ink is printed from the cartridge onto print media that is directed through a printer to be adjacent to the cartridge, wherein the print media has a printable surface between a leading edge and a trailing edge, the method comprising the steps of:

directing the print media through the printer so that the leading edge is spaced by a gap from the trailing edge;

repeatedly directing the print media to be adjacent to the cartridge in a manner such that the printable surface and the gap are alternately located adjacent to the cartridge;

printing from the cartridge when the printable surface is adjacent to the cartridge and while the carriage is in a first printing location relative to the media; and moving the carriage against a stop member and into a second printing location relative to the print media while the gap is adjacent to the cartridge.

5. The method of claim 4 including the steps of:

advancing the stop member from a first position to a second position while the printable surface is adjacent to the cartridge.

6. The method of claim 4 including the step of rotating the print media in the printer so that the printable surface is repeatedly directed to be adjacent to the cartridge and such that the gap is smaller than the distance between the leading edge and trailing edge of the print media.

7. The method of claim 6 wherein the step of rotating the print media includes the steps of directing the printable surface to be adjacent to the cartridge by an amount of time that is greater than the amount of time that the gap is located adjacent to the cartridge.

8. The method of claim 6 further comprising the steps of:

moving the carriage out of the second printing location and against another stop member by reversing the direction of the carriage movement relative to a direction the carriage is moved into the second printing location.

9. A printer carriage and stop assembly, comprising:

a carriage mounted for controlled reciprocating movement along a path within a printer;

a stop mounted to the printer near the carriage and movable relative to the carriage, the stop including a first abutment member that protrudes into the path of the carriage thereby to limit movement of the carriage along the path;

carrier means for directing print media through the printer to be adjacent to the carriage path, wherein the print media has a printable surface between a leading edge and a trailing edge; and handling means for holding the print media in the printer so that the leading edge is spaced by a gap from the trailing edge and for repeatedly directing the print media to be adjacent to the carriage so that the printable surface and the gap are alternately located adjacent to the carriage.

10. The assembly of claim 9 wherein the carriage path is oriented to be substantially perpendicular to a media feed direction along which a sheet of print media is directed through the printer, and wherein the stop is movable in increments along a stop path that is substantially parallel to the carriage path, so that the first abutment member is positionable to control incremental movement of the carriage along the carriage path.

11. The assembly of 10 wherein the stop includes a second abutment member that protrudes into the path of the carriage.

12. The assembly of claim 11 wherein the first and second abutment members are spaced apart, thereby to extend across opposite sides of the carriage.

13. The assembly of claim 9 further comprising control means for independently controlling the reciprocating movement of the carriage and the movement of the stop.

14. The assembly of claim 9 wherein the carrier means includes a drum for supporting the print media as it is directed through the printer.

15. The assembly of claim 9 wherein the carriage is configured to carry more than four print cartridges.

16. An indexing stop for controlling movement of a carriage that is reciprocated along a path in a printer, comprising:

a base slidably mounted for movement next to the carriage path and for movement parallel with the carriage path; and a first abutment member attached to the base and protruding into the path of the carriage to abut the carriage and thereby limit movement of the carriage in a first direction along the path and control means for holding the stop at a first location in the path until the carriage becomes motionless after the carriage abuts the first abutment member.

17. The stop of claim 16 further comprising a second abutment member attached to the base and protruding into the path of the carriage to abut the carriage and thereby limit movement of the carriage in a second direction along the path.

* * * * *